US005185970A

United States Patent [19]

Fiocchi

[11] Patent Number: 5,185,970

[45] Date of Patent: Feb. 16, 1993

[54] EXPANDING DEVICE FOR SUPPORTING GRINDING SLEEVES

[75] Inventor: Roberto Fiocchi, Vittuone, Italy

[73] Assignee: Sprint Filter S.r.l., Milan, Italy

[21] Appl. No.: 783,734

[22] Filed: Oct. 28, 1991

[30] Foreign Application Priority Data

Oct. 31, 1990 [IT] Italy ..... 22040/90[U]

[51] Int. Cl.[5] ..... B24D 9/02

[52] U.S. Cl. ..... 51/372; 51/375; 51/358

[58] Field of Search ..... 51/358, 372, 375, 4, 51/16, 141, 170 EB, 328; 15/149, 104.19

[56] References Cited

U.S. PATENT DOCUMENTS 1,906,190 4/1933 Tautz ..... 51/375
2,777,330 1/1957 Barclay ..... 51/170 EB
3,287,863 11/1966 Field ..... 51/375
3,828,489 8/1974 Culley ..... 51/375
4,458,453 7/1984 Helms et al. ..... 51/375

FOREIGN PATENT DOCUMENTS 3243598 5/1984 Fed. Rep. of Germany .

*Primary Examiner*—Bruce M. Kisliuk
*Assistant Examiner*—Bryan S. Reichenbach
*Attorney, Agent, or Firm*—Guido Modiano; Albert Josif

[57] ABSTRACT

The expanding device for supporting emery cloth sleeves in particular, includes a shaped shaft which concentrically supports a plurality of mutually facing disks which can slide in an axial direction and which are rigidly rotationally connected with the shaft. The disks define, between one another in cooperation, a plurality of peripheral seats for the accommodation of elastic rings which can expand radially upon the axial compression of the disks. The elastic rings are suitable for engaging the inner surface of an emery cloth sleeve.

2 Claims, 1 Drawing Sheet

EXPANDING DEVICE FOR SUPPORTING GRINDING SLEEVES

BACKGROUND OF THE INVENTION

The present invention relates to an expanding device for supporting grinding sleeves such as emery cloth sleeves in particular.

As is known, in order to perform the surface finishing of mechanical parts in general, sleeves of emery cloth are currently used and are applied to a supporting device which is commonly termed expander and which has the function of supporting and rotating said sleeve.

Currently commercially available expanders are generally constituted by a shaft on which a rubber sleeve is provided and arranged inside the emery cloth sleeve; by axial compression, said rubber sleeve undergoes an expansion which causes the anchoring of the emery cloth sleeve.

This solution has the disadvantage that it does not perform a uniform expansion along the entire length of the support, and in particular in general there is a greater expansion in the central region with respect to the end regions. This causes said sleeve to be subjected to different wear actions, since it is unavoidably at least partially deformed by the uneven expansion of the rubber sleeve.

Furthermore, with this embodiment, difficulties are often encountered in inserting and removing the emery cloth sleeve on and from the rubber expander.

Other constructively very complicated solutions have radially expandable sectors, which do not have the possibility of ensuring perfect concentricity of the emery cloth sleeve, with subsequent difficulty in use and faster wear of said sleeve.

SUMMARY OF THE INVENTION

The aim of the invention is indeed to eliminate the disadvantages described above by providing an expanding device for supporting emery cloth sleeves in particular, which allows to obtain a uniform expansion along the entire axial length of the emery cloth sleeve, so that said sleeve does not undergo uneven surface deformations which modify its configuration.

Within the scope of the above aim, a particular object of the invention is to provide an expanding device wherein there is a perfectly concentric connection of the emery cloth sleeve with respect to the shaft, which thereby obtains a greater and accurate uniformity in treatment.

Another object of the present invention is to provide an expanding device which allows extremely rapid and easy operations for the insertion and removal of the sleeve, which consequently reduces operating times.

Another object of the present invention is to provide an expanding device which does not create troublesome space occupations outside said sleeve, thus allowing good handiness and consequent versatility in use.

Not least object of the present invention is to provide an expanding device which can be easily obtained starting from commonly commercially available elements and materials and is furthermore competitive from a merely economical point of view.

This aim, the objects mentioned and others which will become apparent hereinafter are achieved by an expanding device for supporting emery cloth sleeves in particular, according to the invention, characterized in that it comprises a shaped shaft which concentrically supports a plurality of mutually facing disks which can slide in an axial direction and are rigidly rotationally associated with said shaft, said disks defining, between them in cooperation, a plurality of peripheral seats for the accommodation of elastic rings which can expand radially upon the axial compression of said disks, said elastic rings being suitable for engaging the inner surface of an emery cloth sleeve.

BRIEF DESCRIPTION OF THE DRAWINGS

Further characteristics and advantages will become apparent from the description of a preferred but not exclusive embodiment of an expanding device for supporting emery cloth sleeves in particular, according to the present invention, illustrated only by way of non-limitative example in the accompanying drawings, wherein.

DESCRIPTION OF THE PREFERRED EMBODIMENTS

Figures 1, 2, 3, 4, 5, 6:
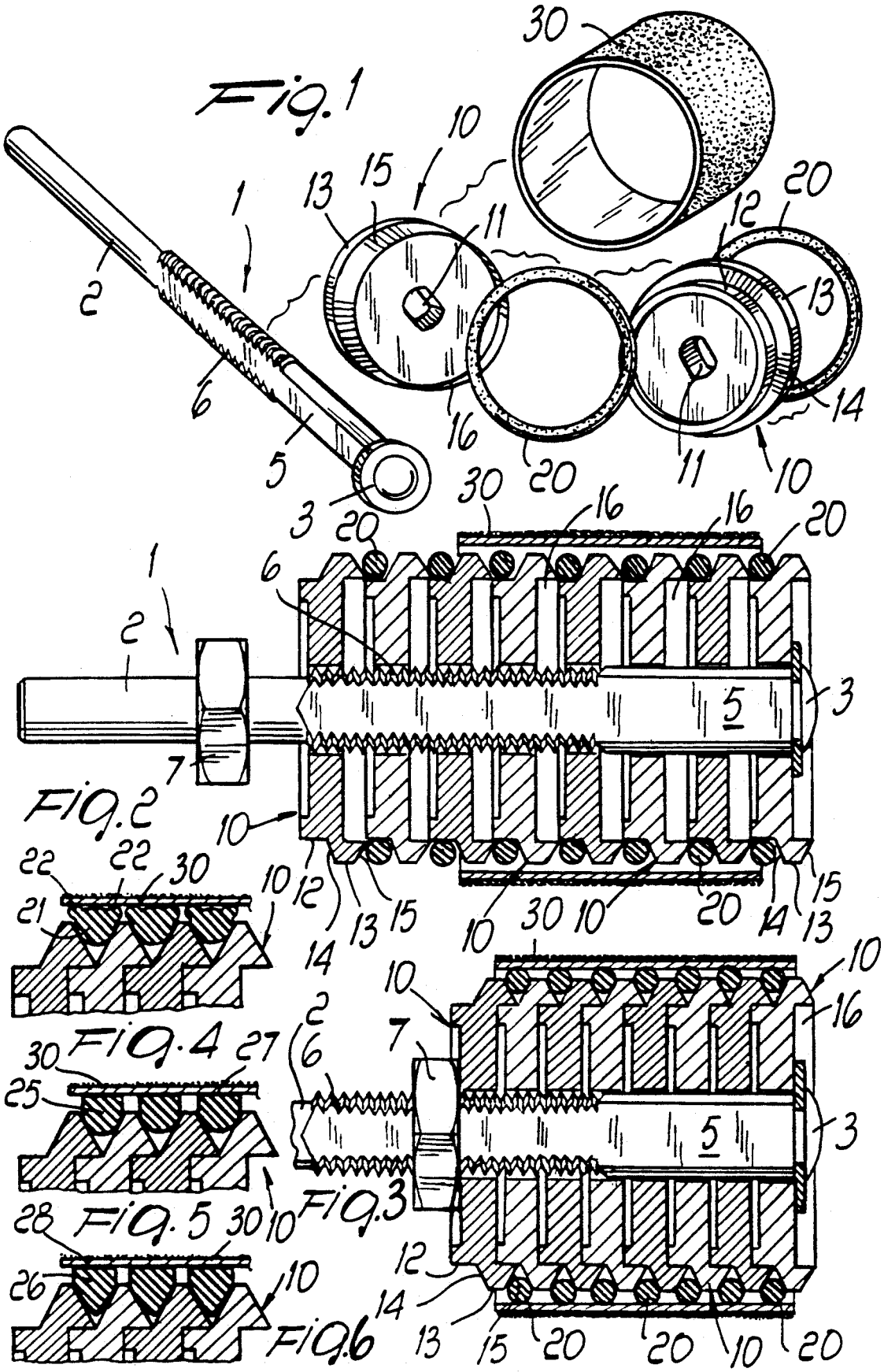
FIG. 1 is an exploded perspective view of the device according to the present invention.
FIG. 2 is a sectional view of the device with the rings in non-expanded position.
FIG. 3 is a sectional view of the device with the elastic rings in radially expanded position in order to retain the emery cloth sleeve.
FIGS. 4, 5 and 6 are views of different configurations of the cross-section of the elastic rings.

With reference to the above figures, the expanding device for supporting emery cloth sleeves in particular, according to the invention, comprises a shaft, generally indicated by the reference numeral 1, which defines, at one end, a stem 2 for its connection to a chuck or the like.

At the other end, a washer 3 or another stop element is fixed to the shaft 1 in order to retain a plurality of disks 10 which are arranged axially face to face, which can slide, and which are rigidly rotationally associated with respect to the shaft 1.

For this purpose, the shaft 1 has a shaped portion 5, obtained, in the specific example, with opposite recesses on the circular cross-section, which engages complementarily shaped holes 11 of the rings 10.

Other shapes which achieve the same effect of radially keying the disks to the shaft, i.e., allowing the axial sliding of the disks with respect to the shaft 1 while keeping them rigidly rotationally associated therewith, may obviously be used.

A threaded portion 6 is furthermore provided on the shaft 1 for engagement with a nut 7, for the function which will be more clearly described hereinafter.

Each disk 10 has a cylindrical flange 12 which is arranged on the continuation of an annular expansion or protrusion 13 which defines oppositely inclined peripheral surfaces or edges 14 and 15 having mutually opposite inclinations which, when arranged mutually face to face, define the accommodation seat for elastic rings 20.

Each disk 10 furthermore defines, on the side opposite to the flange 12, a base having formed therein a cylindrical recess 16 which allows the insertion of the flange of the facing ring.

As illustrated in FIG. 2, in the non-expanded position the elastic ring 20 in practice is coupled with the flange 12 and defines an outer diameter which is smaller than the inner diameter of the emery cloth sleeve 30, so that the insertion of said sleeve is extremely simple and easy.

Once inserted, the nut 7 is acted on and causes a mutual axial compression of the various disks 10, which by virtue of the shape of their peripheral edges 14 and 15 exert a radial expansion action with respect to the elastic rings 20, which are expanded against the inner surface of the sleeve.

Naturally, the cross-section of the rubber rings is such as to allow a uniform circular expansion by means of the compression which occurs between one disk and the other, and the diameter of the rubber disks is calculated so as to allow the rapid and easy insertion of the emery cloth sleeves and to allow, during the expansion step, an excellent securing of said sleeve.

In this manner, the emery cloth sleeve is supported in various points which are uniformly distributed along the axis, so that deformations in specific points of said sleeve are not created and said sleeve accordingly has an optimum working surface.

Furthermore, if one wishes to increase the surface of contact between the rings and the sleeves, especially in the case of large-diameter devices with a small number of disks, it is possible to use a different cross-section, as illustrated in FIGS. 4, 5 and 6.

In particular, FIG. 4 illustrates a ring 21 with tabs or protuberances 22 on the outer surface thereof; the elasticity of the connection is thus increased.

FIGS. 5 and 6 illustrate rings 25 and 26 which have an outer planar region 27 and 28 which increases the sleeve contact region.

To the above it should be furthermore added that it would be conceptually possible to provide the threaded portion of the shaft 1 at the free end, but in this case the bolt, by engaging at the free end, might create a protrusion in an axial direction which is troublesome for some kinds of work.

From what has been described above it can thus be seen that the invention achieves the intended aim and objects, and in particular the fact is stressed that an expanding device is provided which allows a uniform expansion of the elastic rings, which can be advantageously constituted for example by simple O-rings or similar elements.

In practice, the materials employed, so long as compatible with the specific use, as well as the contingent shapes and dimensions, may be any according to the requirements.

I claim:

1. Expanding device for supporting grinding sleeves, in particular emery cloth sleeves, comprising:

a shaft;

a plurality of axially aligned disks supported concentrically on said shaft, said disks being slideable in an axial direction and radially keyed to said shaft, a plurality of seats formed on peripheral faces of said disks;

a plurality of elastic rings accommodated in said seats, said elastic rings expanding radially upon axial compression of said disks for engaging an inner surface of an emery cloth sleeve;

an axially protruding cylindrical flange formed on each of said disks;

a radial protrusion formed on each of said disks and extending away from said flange;

oppositely inclined peripheral surfaces formed on each of said disks, said oppositely inclined peripheral surfaces delimiting said radial protrusion and defining said peripheral seats;

a base defined by each of said disks on a face thereof located opposite to said axially protruding cylindrical flange, and a recess formed on said base of each of said disks;

wherein a cylindrical flange of an adjacent facing disk is accommodatable in said recess.

2. Expanding device according to claim 1, wherein said elastic rings each have an outer surface, and wherein said outer surface has formed thereon a pair of protuberances, said pair of protuberances being engageable with an emery cloth sleeve.

* * * * *